US005312539A

United States Patent [19]

Thomson

[11] Patent Number: 5,312,539

[45] Date of Patent: May 17, 1994

[54] ELECTROLYTIC TIN PLATING METHOD

[75] Inventor: Donald Thomson, Northport, N.Y.

[73] Assignee: LeaRonal Inc., Freeport, N.Y.

[21] Appl. No.: 76,750

[22] Filed: Jun. 15, 1993

[51] Int. Cl.[5] ..... C25D 21/22; C25D 21/18

[52] U.S. Cl. ..... 205/101; 205/154; 205/302; 204/DIG. 13

[58] Field of Search ..... 205/101, 302, 154; 204/DIG. 13

[56] References Cited

U.S. PATENT DOCUMENTS 4,052,276 10/1977 Yoshida et al. ..... 205/101
4,181,580 1/1980 Kitayama et al. ..... 205/101
4,432,844 2/1984 Himoda et al. ..... 204/DIG. 13
4,459,185 7/1984 Obata et al. ..... 205/302
4,789,439 12/1988 Bunk et al. ..... 205/101
5,082,538 1/1992 DeRespiris et al. ..... 205/140

*Primary Examiner*—John Niebling
*Assistant Examiner*—Kishor Mayekar
*Attorney, Agent, or Firm*—Ostrolenk, Faber, Gerb & Soffen

[57] ABSTRACT

A method for plating tin onto the surface of steel strip in an acidic electrolyte bath utilizing insoluble anodes is disclosed. Free acid in the bath is extracted from the bath and concentrated. Tin is dissolved in the concentrated extract and the extract is returned to the bath to replenish the tin in the bath.

9 Claims, 1 Drawing Sheet

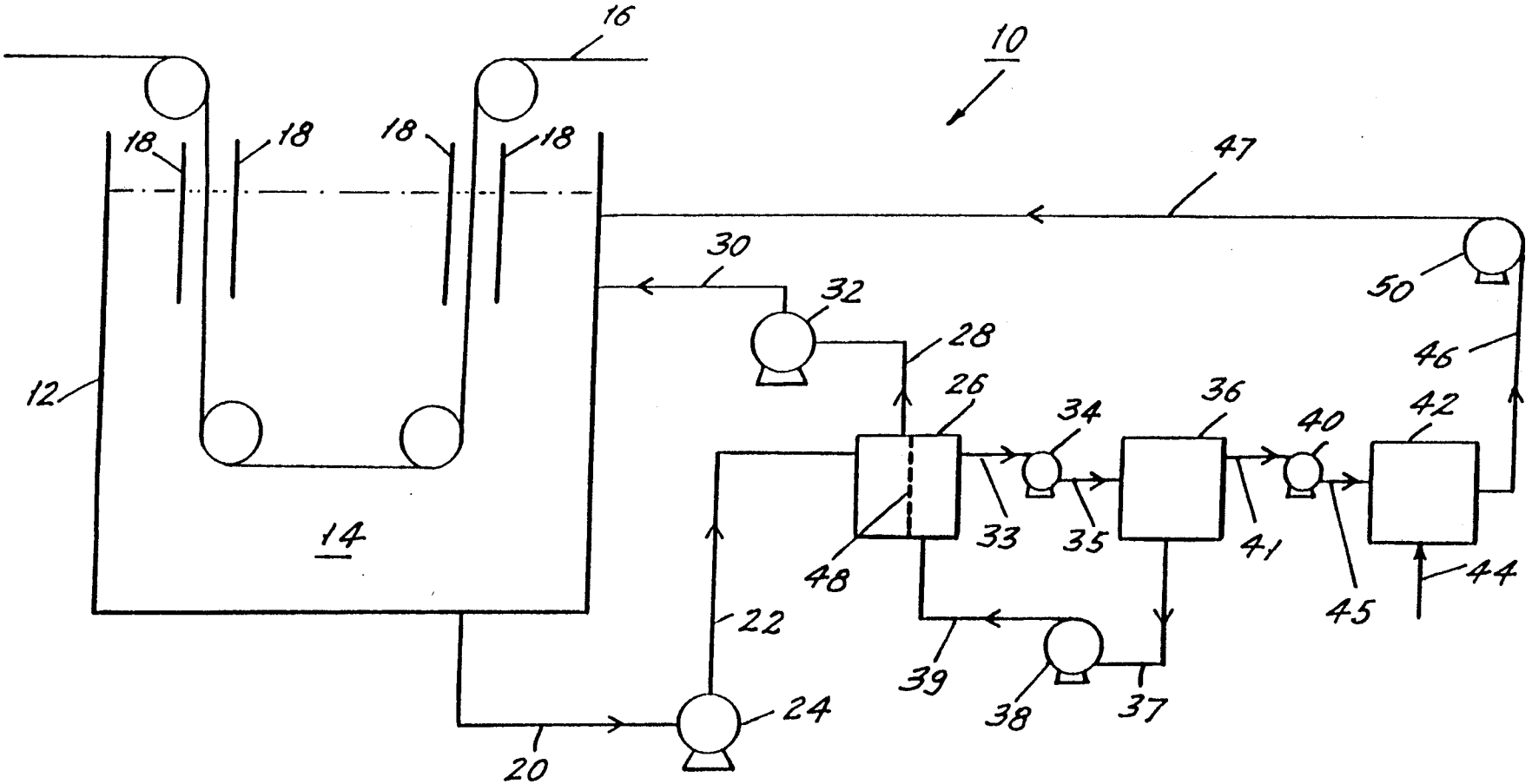
10
12
14
16
18
18
18
18
20
22
24
26
28
30
32
33
34
35
36
37
38
39
40
41
42
44
45
46
47
48
50

ELECTROLYTIC TIN PLATING METHOD

BACKGROUND OF THE INVENTION

1. Field of the Invention

The present invention relates to electrolytic plating and, more particularly, an improved method and electrolytic plating line for plating tin on metallic surfaces, such as steel strip, using insoluble anodes.

2. Description of the Related Art

Tin plating on steel strip using insoluble anodes is known. See, for example, U.S. Pat. No. 4,181,580, the disclosure of which is herein incorporated by reference. This patent teaches a method for electrolytic tinning of steel strip in an electrolytic bath containing tin ions. The bath contains divalent tin ions which are combined with acid and some free acid, that is, acid not combined with tin. When tin plates out, the acid previously combined with tin becomes free. The concentration of tin ions in the bath is controlled by removing electrolyte solution from the bath and contacting the same with particulate tin in a fluidized bed reactor. The net result is to replenish the tin in the bath that has plated out and to take up the free acid that was formerly combined with tin before the tin was plated out. A high content of dissolved oxygen is maintained in the solution by providing additional oxygen to the solution fed into the reactor. Solution replenished with tin is returned to the bath.

However, a significant amount (5–15%) of the dissolved tin in this process becomes tetravalent tin and forms an insoluble oxide sludge. All percentages expressed herein are weight percentages unless otherwise noted. This is a very costly loss of tin. The balance of the tin is dissolved as divalent tin, which is the useful form in the plating process. The loss of tin, caused by the strong oxidizing condition generated by bubbling oxygen, is so serious that many tin plate manufacturers who wish to change to insoluble anodes are remaining with soluble anodes.

It is an object of the present invention to provide a tin plating method which avoids the disadvantage noted above.

SUMMARY OF THE INVENTION

This objective and other objectives, are achieved by the tin plating method of the invention wherein tin is plated onto a metallic surface, preferably steel strip, using an insoluble anode. The metallic surface is made a cathode and is immersed in an acidic electrolyte bath. The bath comprises free lower alkane or alkanol sulfonic acids combined with divalent tin. Tin is plated out of the bath. A portion or all of the free acid is extracted from the bath and concentrated. Tin is dissolved in the concentrated free acid extract and the extract is returned to the bath to replenish the bath with tin.

In preferred aspects of the method of the invention, the bath includes about 25 to about 50 g/l of acid combined with the divalent tin and about 25 to about 50 g/l of free acid, most preferably about 30 g/l of the acid combined with the divalent tin (most preferably stannous methane sulfonate) and about 30 g/l of the free acid (most preferably methane sulfonic acid). To extract free acid, a portion of the bath removed from a bath holding container may be contacted with an anion exchange membrane, the membrane having an acid concentration gradient across the membrane to extract free acid by diffusion dialysis. The extracted free acid may be concentrated by known methods about ten or more times. Stannous oxide may be added to the concentrated free acid extract to dissolve tin therein while agitating the same to form a solution of stannous methane sulfonate which is then returned to the bath. Alternatively, tin may be dissolved in the concentrated free acid extract using an electrolysis cell. The concentrated free acid extract may be added to an anode chamber of the cell, the anode chamber containing a tin electrode, and an acid may be added to the cathode chamber. The anode chamber may then be enriched with tin from the tin anode to form a stannous salt of the concentrated free acid extract. Another alternative for dissolving tin into the concentrated free acid extract is to react that extract with tin metal in the presence of catalyst.

A tin plating line is also provided by the invention. The line includes a lower alkane or alkanol sulfonic acid, electrolyte bath, a container for the bath and one or more insoluble anodes. Free acid contained in the bath is extracted in an extractor device and concentrated in a concentrator device. Tin is added to the concentrated free acid extract in a tin dissolver device. A recycle is provided to return the concentrated free acid extract containing tin to the bath.

In preferred aspects of the plating line of the invention, the extractor includes a diffusion dialysis membrane. The membrane extracts free acid from the bath due to a free acid concentration gradient across the membrane, as discussed above. The dissolver may be a container for holding the concentrated free acid extract, a device for adding stannous oxide to the container and an agitator for agitating the concentrated free acid extract. Alternatively, the dissolver may be an electrolysis cell including anode and cathode chambers, a tin anode being located in the anode chamber. As was also discussed above, while the concentrated free acid is contained in the anode chamber, the tin anode enriches the anode chamber with tin to form a stannous salt of the concentrated free acid extract. A further alternative for dissolving the tin in the concentrated free acid extract is a device, such as any suitable reactor, for contacting the concentrated free acid extract with tin in the presence of a catalyst. Other suitable methods for dissolving tin can be used.

The term "free acid" as used herein, means lower alkane or alkanol sulfonic acid in the electrolytic bath which is not combined with tin.

Other features and advantages of the present invention will become apparent from the following description of the invention which refers to the accompanying drawings.

BRIEF DESCRIPTION OF THE DRAWINGS

The drawing illustrates a tin plating line in accordance with the invention.

DETAILED DESCRIPTION OF THE DRAWING

Referring now to the drawing, there is shown a plating line in accordance with the invention and designated generally as 10. Plating line 10 includes any suitable container, such as a tank 12, for containing electrolyte bath 14. Immersed in bath 14 is a steel strip 16, which is made a cathode, and insoluble anodes 18. A portion of bath 14 containing free acid is removed from tank 12 through lines 20 and 22 and pumped by pump 24 to free acid extractor 26. Recycle lines 28 and 30 are provided to recycle bath solution back to tank 12 by means of pump 32. Extracted free acid is pumped through lines 33 and 35 by pump 34 to concentrator 36 where it is concentrated and then is pumped through lines 41 and 45 by pump 40 to tin dissolver 42. Separated water is recycled back from concentrator 36 to extractor 26 through lines 37 and 39 by pump 38. Tin is added through line 44 to dissolver 42. Concentrated free acid extract containing tin is returned to bath 14 through lines 46 and 47 by pump 50.

Electrolyte bath 14 may be a lower alkane or alkanol sulfonic acid electrolyte bath. Preferably, bath 14 comprises about 40 to about 80 g/l of a stannous salt of any suitable acid, for example, stannous methane sulfonate, and about 20 to about 50 g/l of free acid, for example, methane sulfonic acid (MSA). Most preferably, bath 14 comprises about 50 g/l of stannous methane sulfonate and about 30 g/l of free MSA, in addition to conventional additives for electrolyte baths, such as antioxidants, grain refiners, etc.

Free acid extractor 26 may be any suitable device for extracting free acid from the portion of bath 14 removed from tank 12. Preferably, free acid is extracted from the removed portion of bath 14 using diffusion dialysis. In such a system, the removed portion of bath 14 may be maintained on one side of an anion exchange membrane 48, and deionized or recycled water, as will be discussed below, may be maintained on the other side of membrane 48. The water side of membrane 48 need only contain less acid than the bath side of the membrane in order to maintain a concentration gradient of free acid across the membrane. Free acid passes through membrane 48 due to the concentration gradient across membrane 48. Small amounts of tin also pass through membrane 48, however, the amount of tin diffusing through membrane 48 is of only minor significance. For example, for the above-mentioned plating solution containing 50 g/l of Stannous Methane Sulfonate and 30 g/l of free MSA was supplied to SLS Technology, New Hyde Park, N.Y. The solution was processed through a laboratory dialysis unit. Incorporating the SLS laboratory unit, one gallon of tin plating solution was connected through a pump to the feed side and one liter of strip solution through a second pump to the strip side of the unit. Flow of the feed and strip solution was concurrent. The acid recovered is shown below:

| Time of Run (minutes) | Acid Recovered (grams) |
|---|---|
| 30 | 6.89 |
| 60 | 19.46 |
| 120 | 37.76 |

The 30 minute data includes time for filling the SLS unit and for the system to reach steady state conditions. Based on the size of the unit, the rate of removal is 50.39 gms/hr per square foot of membrane area. The amount of tin passing through membrane was less than 0.6 grams/hr per square foot of membrane area.

Other diffusion dialysis membranes and techniques will be apparent to one skilled in the art.

The extracted free acid flows through line 33 and 35 to concentrator 36 which may be any suitable concentration device. The extracted free acid is concentrated approximately 10 times or more using conventional techniques such as reverse osmosis and/or evaporation. If reverse osmosis is incorporated, approximately 90% of the water can be removed using multiple pass techniques, whereas the dilute solution passes first through one reverse osmosis unit and then a second and so forth until approximately 90% of the water is removed. The stream may then pass into an evaporator to remove a portion of the remaining water if it is necessary. The separated water is recycled through lines 37 and 39 by pump 38 to the water side of membrane 48. Other concentrating techniques will be apparent to those skilled in the art.

Concentrated free acid flows through lines 41 and 45 to tin dissolver 42. Any suitable device may be utilized in this step of the invention to dissolve the tin metal or stannous oxide into the concentrated free acid extract.

For example, stannous oxide in an amount of preferably about 100 grams per 200 grams of concentrated free acid extract may be added in any suitable container under conditions including vigorous agitation, such as stirring, etc. in order to generate stannous methane sulfonate. The resultant solution may then be filtered using any suitable known filtering device to remove any undissolved tin oxide and pumped by pump 50 back to bath 14 through lines 46 and 47.

Alternatively, electrolysis using an ion exchange membrane may be employed to dissolve tin into the concentrated free acid. For example, the concentrated free acid extract may be added as an anolyte to the anode chamber of an electrolysis cell containing an anion exchange membrane such as Nafion 324 available from E.I. Dupont de Nemours & Co., Wilmington, Del. The cathode chamber may contain MSA solution as a catholyte. Tin metal is used as the anode and any suitable inert metal is used as the cathode. An anode current density of about 50–150 amperes per square foot, preferably about 100 amperes per square foot is maintained in the cell. The anodic exchange membrane prevents passage of tin ions, and therefore the tin concentration in the solution contained in the anolyte compartment increases.

The solution contained in the anolyte compartment, which is enriched with tin, may then be recycled back into bath 14.

Tin may also be dissolved in the concentrated free acid extract by reacting tin metal with the concentrated free acid extract in the presence of a catalyst. One suitable process of this type is disclosed in U.S. Pat. No. 4,822,580, the disclosure of which is herein incorporated by reference.

It should be noted that the amount of tin dissolved in the techniques discussed above example should be equivalent to the amount of tin plated out of tank 14 during electrolysis. This is necessary in order to maintain a constant tin concentration in tank 14.

Other devices and techniques for dissolving tin into the concentrated free acid extract will be apparent to one skilled in the art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for electrolytically plating tin onto a cathodic metallic surface using an insoluble anode and an acidic electrolyte bath comprising lower alkane or alkanol sulfonic acid, comprising the steps of:

a) immersing the metallic surface in the acidic electrolyte bath, the bath comprising a free acid and an acid combined with divalent in wherein the acid is a lower alkane or alkanol sulfonic acid;

b) plating tin out of the bath onto the metallic surface;

c) extracting at least a portion of the free acid from the bath to form a free acid extract;

d) concentrating the free acid extract to form a concentrated free acid extract;

e) dissolving tin in the concentrated free acid extract; and f) returning the concentrated free acid extract with the tin dissolved therein to the bath to replenish the bath with tin.

2. The method of claim 1, wherein in step a) the metallic surface is a steel strip.

3. The method of claim 1, wherein step a) comprises the step of immersing the metallic surface in the acidic electrolyte bath comprising lower alkane or alkanol sulfonic acid containing about 25 to about 50 g/l of the acid combined with the divalent tin and about 20 to about 50 g/l of the free acid.

4. The method of claim 3, wherein step a) comprises the step of immersing the metallic surface in the acidic electrolyte bath comprising about 30 g/l of the acid combined with the divalent tin and about 30 g/l of the free acid.

5. The method of claim 4, wherein step a) comprises the step of immersing the metallic surface in the acidic electrolyte bath comprising about 50 g/l of stannous methane sulfonate and about 30 g/l of methane sulfonic acid.

6. The method of claim 1, wherein step c) comprises removing a portion of the acidic electrolyte bath, contacting the removed portion of the bath with an anion exchange membrane and maintaining a concentration gradient across the membrane to extract free acid from the removed portion of the bath by diffusion dialysis across the membrane.

7. The method of claim 1, wherein step e) comprises adding stannous oxide to the concentrated free acid extract while agitating the concentrated free acid extract to form a solution of stannous methane sulfonate.

8. The method of claim 1, wherein step e) comprises adding the concentrated free acid extract to an anode chamber of an electrolysis cell, adding an acid to a cathode chamber of the cell and enriching the concentrated free acid extract in the anode side of the electrolysis cell using a tin anode to form a stannous salt of the concentrated free acid extract.

9. The method of claim 1, wherein step e) comprises reacting tin metal with the concentrated free acid extract.

* * * * *